US005084161A

United States Patent [19]

Vikiö

[11] Patent Number: 5,084,161

[45] Date of Patent: Jan. 28, 1992

[54] METHOD AND APPARATUS FOR THE REMOVAL OF LIGHT MATERIAL FROM A FIBER SUSPENSION

[75] Inventor: Pentti A. Vikiö, Kerimäki, Finland

[73] Assignee: A. Ahlstrom Corporation, Noormarkku, Finland

[21] Appl. No.: 377,890

[22] Filed: Jul. 10, 1989

[30] Foreign Application Priority Data

Jul. 12, 1988 [FI] Finland ..... 883307

[51] Int. Cl.[5] ..... B03B 7/00; B01D 19/00

[52] U.S. Cl. ..... 209/2; 162/380; 209/12; 209/17; 209/211

[58] Field of Search ..... 209/2, 12, 17, 211, 209/13, 18; 162/55, 380

[56] References Cited

U.S. PATENT DOCUMENTS 3,206,917 9/1965 Kaiser et al. ..... 162/380 X
3,279,597 10/1966 Reinhall ..... 209/17
3,421,622 1/1969 Wurtmann ..... 209/211
3,812,007 5/1974 Kaiser ..... 162/380 X
4,146,469 3/1979 Kaiser et al. ..... 209/211
4,238,208 12/1980 Frykhult et al. ..... 162/380 X

FOREIGN PATENT DOCUMENTS 3043729 6/1981 Fed. Rep. of Germany ..... 162/380

*Primary Examiner*—Donald T. Hajec
*Attorney, Agent, or Firm*—Cohen, Pontani, Lieberman

[57] ABSTRACT

A method and apparatus for the removal of light material from a fiber suspension particularly suitable for removing light compressible plastic material such as expanded polystyrene and similar material from the short circulation of a paper machine. The plastic particles containing fiber suspension is divided in a degassing tank into reject and accept flows by the assistance of vacuum. The light reject containing flow is separated from the main flow by an overflow device and recirculated to the wire pit or corresponding device. A separation device such as a vibrating screen, vibrating drum, curved screen or inverted cyclone is provided within the light reject flow return duct for removing the detrimental plastic or other light material from the short circulation and for preventing the accumulation thereof in the wire pit.

17 Claims, 2 Drawing Sheets

METHOD AND APPARATUS FOR THE REMOVAL OF LIGHT MATERIAL FROM A FIBER SUSPENSION

FIELD OF THE INVENTION

The present invention relates to a method and apparatus for the removal of light weight material from a fiber suspension, such, for example, as from the stock supplied to the headbox of a paper machine immediately after air is removed from the stock. The method and apparatus in accordance with the present invention are particularly suitable for the removal of plastics, particularly compressible plastic material and expanded polystyrene and similar light weight material.

BACKGROUND ART

Many different types of apparatus are known for the removal of light reject from fiber suspensions. For example, U.S. Pat. No. 4,634,521 discloses a screen in which so-called plastics separation is arranged inside a rotor. However, the described pressurized apparatus is not capable of reliably removing, for example, particles of expanded polystyrene as such particles are compressible and are, therefore, due to the pressurized atmosphere within the apparatus, compressed and pass through the apertures of the screen to the accept flow.

In addition, light weight compressible material can also successfully be removed from fiber suspensions with known vibrating screen and drums. Also, curved screens can be used for this purpose (U.S. Pat. No. 4,333,572) as well as an inverted cyclone as disclosed in Canadian Patent 1,203,778. The above disclosed devices have been used in the paper manufacturing process for the separation of light weight waste material, so-called light reject, by passing the stock flow through the separator which, of course, means that the number and/or the size of the devices have increased which also correspondingly increased the installation, operation and maintenance costs thereof.

Typically in the paper making process, as much gas as possible is withdrawn from the fiber suspension before the suspension is fed onto the forming wire of the paper machine. Most commonly used for the removal of gas from the fiber suspension is a device wherein the fiber suspension is initially conveyed to a tank in which a negative pressure is maintained. The level of stock in the tank is kept constant either by providing an overflow over a weir or partition wall, thus separating the stock to be fed to the headbox from the stock which is returned to the circulation (U.S. Pat. No. 4,419,109), or by regulating with a transducer the pumping of the stock to the tank, or by a combination of both. The negative pressure prevailing in the tank, the amount of which is adjusted to be close to the boiling pressure of the suspension, causes the gases in the suspension both, in the form of bubbles and in a dissolved state, to be separated from the suspension whereby the gases are readily removable with a vacuum generating device. It is typical of the first mentioned apparatus that the fiber material passing the overflow is recirculated by directing the flow to the wire pit or to a corresponding location at the inlet of the screening device, usually hydrocyclones, which precede the air removing device in the process. Frequently large amounts of light plastic rejects or the like collect at the surface of the stock suspension in the wire pit and tend to accumulate in the short circulation. This is, of course, less detrimental than the light plastics flowing to the headbox and further onto the wire where they cause holes in the paper manufactured. However, there is no disclosure in the prior art for removing light reject from fiber suspensions in connection with the removal of air therefrom.

Today, the fiber suspensions generally contain more and more light substances which are compressible in a way that they cannot be reliably removed with pressurized perforated or slotted screens. Such light substances will therefore accumulate in the process and, in the long run, will cause problems in the end product. It is, therefore, desirable to provide a phase in the suspension treatment process in which the light material can be removed. Since the light reject contains mainly compressible material a proper removal of the reject can only be achieved at a point where the suspension is not under pressure. For example, in the degassing system of a paper machine short circulation light material present in the fiber suspension will rise to the surface and pass via an overflow to the wire pit and, more generally, to the short circulation.

SUMMARY OF THE INVENTION

In the method and apparatus of the present invention, the fiber suspension flowing over a weir or overflow in the degassing tank and thus separated from the main flow volume is directed to the wire pit via means for the separation of light material from the suspension, thereby preventing accumulation of light material in the short circulation. The amount of suspension separated from the main flow is less than about 15%, preferably between about 2 and about 5%, of the total suspension flow volume.

In a stock treatment system which does not include degassing devices, a vessel or container for the separation of light material is added to the system. In a separation vessel the light material is allowed to be separated by itself an is thereafter guided away as a partial flow to be cleaned separately. This results in a marked reduction of investments with respect to the apparatus as the entire suspension volume need not be circulated through the light particle separation unit.

It is thus a characteristic feature of the method according to the present invention that light material or reject contained in the fiber suspension is collected in a partial flow of the total suspension flow. The partial flow containing the light reject is separated from the main flow and the light material is thereafter removed from said partial flow.

The apparatus of the present invention includes a vessel or container into which the suspension to be treated is directed, means in the container for separating the light material as a partial flow from the main or total flow volume, and means connected to the container for separating the light material from the partial flow.

BRIEF DESCRIPTION OF THE DRAWINGS

The method and the apparatus of the present invention are described in more detail with reference to the accompanying drawings in which.

DETAILED DESCRIPTION OF THE PRESENTLY PREFERRED EMBODIMENT

Figure 1:
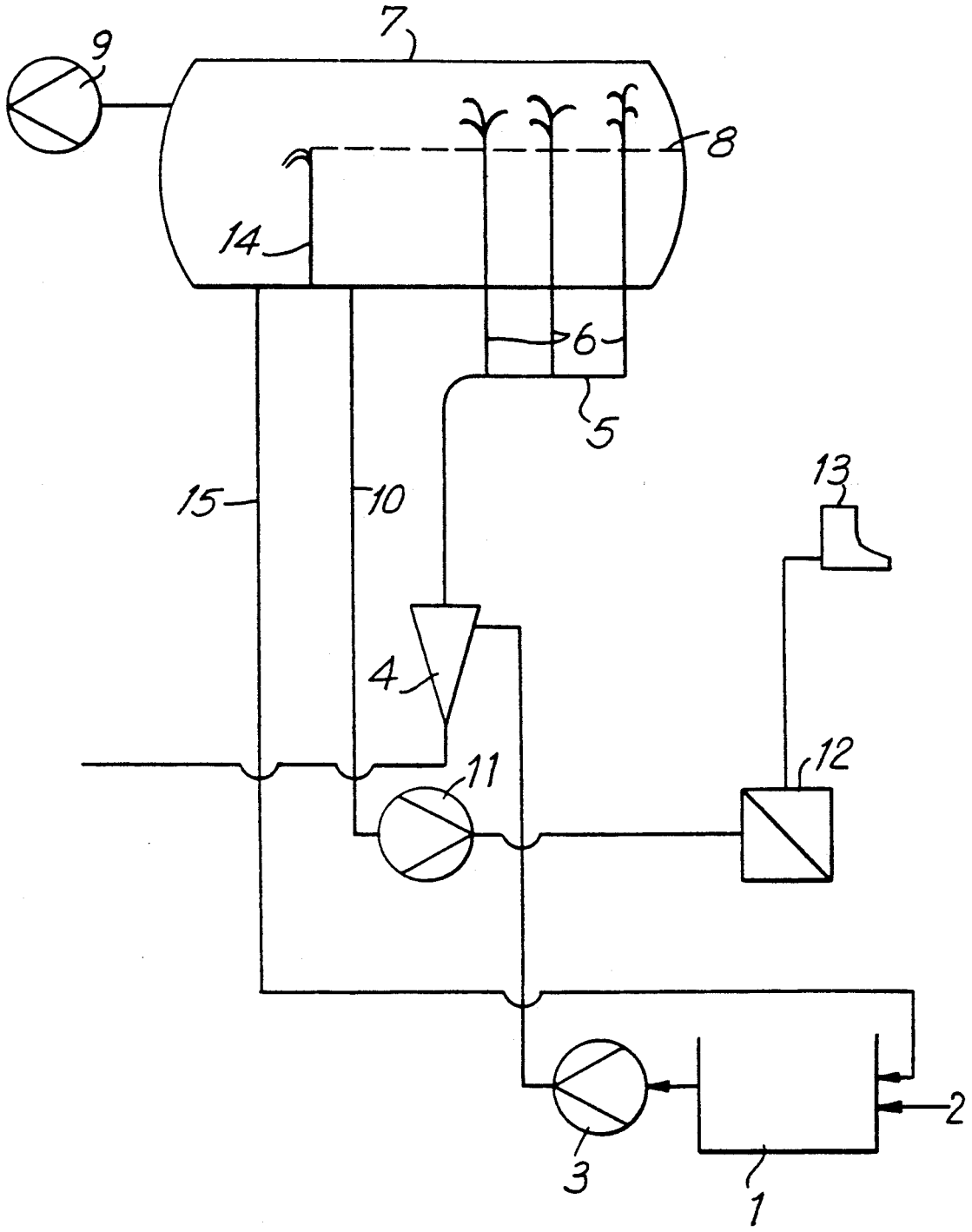
FIG. 1 PRIOR ART
FIG. 1 is a schematic illustration of the short circulation of a prior art paper machine.

The short circulation of a prior art paper machine illustrated in FIG. 1 starts at a wire pit 1. Fiber containing water, so-called white water, filtrated through the wires of a paper machine flows to the wire pit 1 to be used for diluting fresh stock to the desired consistency which stock is introduced through conduit 2. The suspension thus produced is pumped in a conventional way by a centrifugal pump 3 to one or more cyclones 4, wherein coarse and heavy impurities are separated from the suspension. From the cyclones 4, the suspension is transferred through conduit 5 and distributed to several feed pipes 6 of a deaeration tank 7. The suspension is sprayed through pipes 6 over and on top of a liquid surface 8 in the tank preferably in a manner so that the spray extends to the top of the tank whereby gas flowing with the suspension is easily separated from the fiber suspension. Further, negative pressure provided in the tank 7 by a vacuum pump 9 also assists in the removal of the gases from the suspension. The stock fed to the paper machine is taken from the bottom of tank 7 via duct 10 to a feed pump 11 which supplies the pressurized stock to power screens 12 and further to a headbox 13.

The level 8 of the liquid fiber suspension in the tank 7 is maintained constant by a partition wall 14 which serves as a weir or overflow over which a part, less than about 15%, and preferably between about 2 and about 5% of the suspension flows. This portion of the flow is transferred via duct 15 to the wire pit 1. The light foreign matter or material tends to be contained in this overflow portion of the fiber suspension in the gas separation tank 7. Part of the light particles, such as expanded polystyrene and similar material, in particular material which was compressed under the pressure in other parts of the system, regain their original volume and even expand further due to the negative pressure prevailing in tank 7. Therefore, the light weight particles will quickly rise to the surface of the suspension in the tank and will pass over the overflow 14 with the partial suspension flow and be further passed to a recirculation duct and on to the wire pit or in general back to the circulation. Depending on the design of the wire pit 1, a large or a small portion of the light weight material will rise to the surface of the fiber suspension in the wire pit but, at any rate, part of the light weight material will remain in the circulation and thus more and more light weight material will accumulate in the short circulation.

Figure 2:
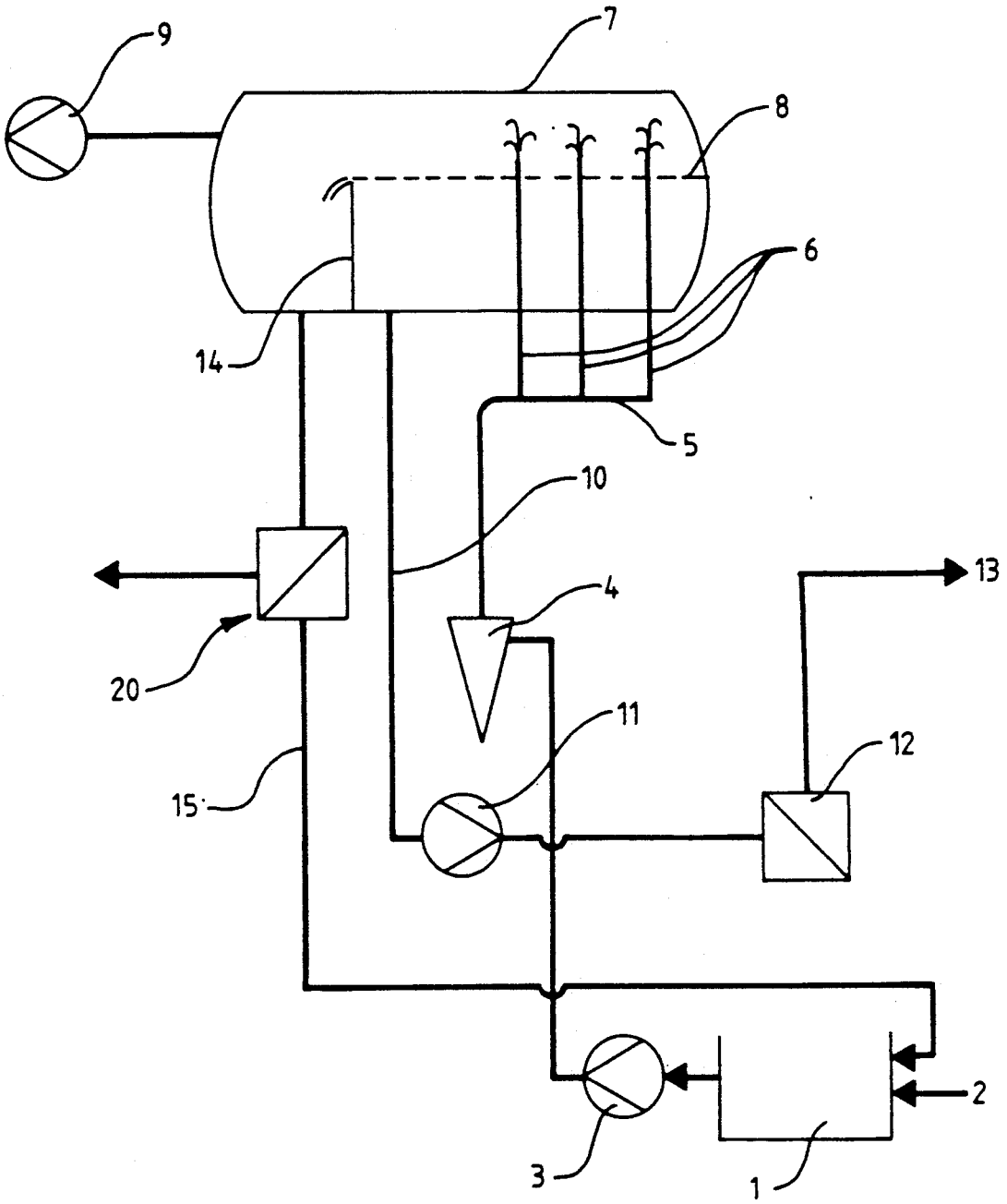
FIG. 2 is a schematic illustration of a paper machine short circulation containing the apparatus of the present invention.

FIG. 2 illustrates an apparatus according to the invention in which separation of the light material in deaeration tank 7 is achieved by providing in the recirculation duct 15 means 20 for separating said material from the suspension. Means 20 may be formed by various known vibrating screens and drums, curved screens or inverted cyclones. The common feature of all suitable separation means is that they operate at low pressure whereby the plastic or corresponding light material in the suspension is not compressed but can be separated from the flow. Further, it is a characteristic feature of the invention that remarkably low apparatus investments are required as the volume of the suspension to be treated in the partial flow is only about 2 to about 5%, in any case less than about 15% of the total flow volume.

Only one preferred embodiment for carrying out the method of the present invention, i.e. the short circulation of a paper machine, has been described above. However, the apparatus and method according to the present invention can also be applied, e.g. in the treatment of waste paper or other processes in which light weight material such as plastics and expanded polystyrene are present. Thus, the deaeration tank 7 described in the above embodiment is to be understood more generally as means for the separation of light weight material by permitting said light weight material to collect at the surface of the fiber suspension, and from which surface the material is further separated by dividing the suspension flow into a main flow and a partial flow containing the light material. Separation means such as deaeration tank 7 is preferably provided with negative pressure which assists substantially in the separation of the light weight material, as for example, expanded polystyrene particles expand intensively in an atmosphere of negative pressure and quickly rise to the surface of the suspension. The time required for the light weight material to move to the surface of the suspension is approximately between about 5 and about 15 seconds which thus corresponds to the time the fiber suspension should stay in the tank.

The above description should be construed as illustrative and not in a limiting sense, the scope of the invention being defined solely by the following claims.

What is claimed is:

1. A method of removing light material from a light material containing fiber suspension flow comprising:

introducing said suspension flow into a vessel so as to form a surface therein;

accumulating said light material in a part of said suspension flow at said surface thereof by subjecting said suspension to negative pressure in said vessel;

separating said light material containing part from the remainder of said suspension flow by permitting said partial suspension flow to pass over an overflow; and separating said light material from said partial flow.

2. The method according to claim 1, wherein said light material is expandable and is accumulated at the surface of said fiber suspension by subjecting the suspension to negative pressure thereby causing said light material to expand and rise to said surface.

3. The method according to claim 1, wherein said partial flow containing said light material is less than about 15% of the total flow volume of said fiber suspension.

4. A method of removing light material from a light material containing fiber suspension prior to the headbox of a paper making machine, comprising:

introducing said fiber suspension into a degassing apparatus;

causing said light material in said degassing apparatus to accumulate at the surface of said fiber suspension;

dividing said fiber suspension into a first partial flow and a second partial flow containing said light material;

directing said first partial flow toward the headbox of the paper machine;

withdrawing said second light material containing partial flow from said degassing apparatus;

separating said light material from said second partial flow after said withdrawal; and thereafter returning said second partial flow to the circulation of the paper machine.

5. The method according to claim 4, wherein said second partial flow containing said light material is less than about 15% of the total flow volume of said fiber suspension.

6. An apparatus for removing rejectable light material from a fiber suspension comprising:

a container for said fiber suspension comprising a bottom portion and an inlet for introducing said fiber suspension into said container;

means located in said container for dividing said fiber suspension into a light material containing rejectable first portion and a second acceptable portion;

means in communication with said container for applying a vacuum to said container and said fiber suspension for assisting said light material division therein;

means for discharging said second acceptable portion from said bottom portion of said container;

means for separating said light material from said first portion; and means connecting said container sand said light material separating means for conveying said light material containing first portion from said container to said light material separating means.

7. The apparatus according to claim 6, wherein said dividing means comprises a partition wall in said container for permitting said first suspension portion containing said light material to be divided from said second portion.

8. The apparatus according to claim 6, wherein said light material separating means comprises a vibrating screen.

9. The apparatus according to claim 6, wherein the light material separating means comprises a vibrating drum.

10. The apparatus according to claim 6, wherein said light material separating means comprises a curved screen.

11. The apparatus according to claim 6, wherein said light material separating means comprises an inverted cyclone.

12. The apparatus according to claim 8, wherein said light material separating means is connected directly to said container.

13. The apparatus according to claim 9, wherein said light material separating means is connected directly to said container.

14. The apparatus according to claim 10, wherein said light material separating means is connected directly to said container.

15. The apparatus according to claim 11, wherein said light material separating means is connected directly to said container.

16. An apparatus for removing light material from a light material containing fiber suspension in a short circulation of a paper making machine comprising:

means communicating with the short circulation of a paper machine for degassing said fiber suspension; said degassing means comprising an inlet for introducing said suspension into said degassing means, a first outlet for withdrawing from said degassing means a first partial fiber suspension flow essentially free from said light material, means for guiding said first partial suspension flow towards the headbox of the paper machine, a second outlet for withdrawing from said degassing means a second partial fiber suspension flow containing said light material and means for returning said second partial flow to said circulation; and means connected to said returning means and said second outlet for separating said light material from said second partial flow.

17. The apparatus according to claim 16, wherein said light material separating means is a vibrating screen, vibrating drum, curved screen or inverted cyclone.

* * * * *